United States Patent [19]

Ochiai et al.

[11] Patent Number: 4,549,352

[45] Date of Patent: Oct. 29, 1985

[54] WASHABLE ELECTRIC SHAVER

[75] Inventors: Masahiko Ochiai; Yoshinori Taito, both of Nogata, Japan

[73] Assignee: Kyushu Hitachi Maxell, Ltd., Fukuoka, Japan

[21] Appl. No.: 532,220

[22] Filed: Sep. 14, 1983

[30] Foreign Application Priority Data

| | | | |
|---|---|---|---|
| Nov. 10, 1982 | [JP] | Japan | 57-170689[U] |
| Nov. 12, 1982 | [JP] | Japan | 57-171831[U] |
| Nov. 12, 1982 | [JP] | Japan | 57-171832[U] |
| Nov. 12, 1982 | [JP] | Japan | 57-171837[U] |

[51] Int. Cl.[4] ..... B26B 19/44

[52] U.S. Cl. ..... 30/41.5; 30/41.6; 30/43.92

[58] Field of Search ..... 30/41, 41.5, 41.6, 43–46, 30/42; 220/260; 49/105, 110, 116, 122

[56] References Cited

U.S. PATENT DOCUMENTS 2,395,296 2/1946 Schwab ..... 30/41.6

4,233,733 11/1980 Gallanis et al. ..... 30/43.92

*Primary Examiner*—Douglas D. Watts

*Attorney, Agent, or Firm*—Birch, Stewart, Kolasch & Birch

[57] ABSTRACT

A washable electric shaver comprising a water-tight housing having a drive motor therein and a switch mounted thereon, and a shaving head. The shaving head has a stationary shear plate cooperable with a movable shear element which, when driven by the drive motor, oscillates in engagement with the stationary shear plate to cut hairs of a beard. The shaving head has a pair of end openings located on respective sides of the movable shear element and adapted to be selectively opened and closed by respective lateral lids which are normally biased so as to close the end openings. The shaver can be washed by allowing a flush of water to flow from one of the end openings to the other through the interior of the head when the lateral lids are in opened positions.

4 Claims, 12 Drawing Figures

WASHABLE ELECTRIC SHAVER

BACKGROUND OF THE INVENTION

This invention generally relates to an electric shaver and, more particularly, to a washable electric shaver which can be used selectively either as a wet type or a dry type.

A washable electric shaver is a recent development in the art and generally comprises, as is the case with the dry type, a shaving head including a stationary shear plate, having a multiplicity of small perforations defined therein, and a power-driven or movable shear element movable relative to and cooperable with the stationary shear plate to cut hairs of a beard and/or a mustache projecting towards the movable shear element through the perforations in the stationary shear plate. In general, of the various features, the employment of a water-tight structure as a housing for the electric circuitry including a motor, a battery source and a switch and rust-resistant material for at least the component parts of the shaving head, may be considered distinguishing the wet type shaver from the dry type, although the wet shaver can also be used as a dry shaver if desired.

The washable electric shaver is considered very convenient in that the clippings of hairs accumulated inside the shaving head can readily be washed off into the drain. This is in contrast to the dry type which, unlike the wet type, cannot be used as a wet type and which requires an occasional or regular cleaning of the shaving head with the aid of a separate brush to remove the clippings.

Also, the wet type has an additional advantage. While it has often been observed with the dry type that some of the hair clippings, once wetted by a fatty secretion from sweat glands in the human face, are incrusted to the cutting edge or edges of the movable shear element so stubbornly as to require a relative strong brushing for the removal thereof, the wet shaver is substantially free from such an inconvenience when used with a soap or a shaving foam applied to the hairs to be shaved. Specifically, when the wet shaver is used with a soap or a shaving foam applied to the hairs to be cut, the secretion from the sweat glands can be neutralized by the soap or the shaving foam and, therefore, some of the wetted hair clippings gathered around the cutting edge or edges of the movable shear element can readily be removed therefrom when the shaving head is flushed with water or washed in a pool of water in a manner similar to the old-fashioned razor.

However, the prior art washable electric shaver is still unsatisfactory in that difficulty is encountered in the achievement of a substantially complete cleaning of the shaving head with water and/or in that, even though the hair clippings inside the shaving head can be substantially completely removed, a complicated and time-consuming handling is required.

To keep a razor sharp so that smooth and comfortable shaving can be appreciated throughout the shaving procedure, it is often desirable to wash the razor with water in a manner to remove the hair clippings with each one or two draws of the razor. This way of using the razor is equally applicable to the washable electric shaver for the same purpose, however the prior art washable electric shaver has a further disadvantage in that water used to flush the shaving head and/or droplets of water remaining in the shaving head after the washing tend to flow downwards to wet the body of the shaver held by the hand of the user. Once the body of the shaver is wetted, holding of the shaver may be hampered because slippage is likely to occur between the hand and the body of the shaver.

Apart from the discussion of the prior art washable electric shavers, the Japanese Utility Model Publication No. 45-9388, published May 2, 1970, discloses the shaving head for an electric shaver which is provided with a pair of simultaneously pivotable lateral lids for selectively opening and closing respective lateral openings leading into the interior of the shaving head. The shaving head disclosed therein comprises a generally elongated movable shear element having a plurality of juxtaposed blades and adapted to be linearly vibrated in a direction longitudinally thereof, and a stationary shear plate having a multiplicity of small perforations defined therein and supported so as to overlay the movable shear element for sliding engagement therewith with the lateral openings defined adjacent to and confronting the opposite ends of the movable shear element. For the selective opening and closing of the lateral openings, a manipulating mechanism is provided, which comprises a knob supported on the casing for the shaver for movement between opened and closed positions and a leaf spring having its opposite ends pivotally connected to the lateral lids, an intermediate portion of the leaf spring being trapped by or secured to the knob. The leaf spring employed therein has a length substantially greater than the linear distance or span between the respective points of pivot of the lateral lids so that a snap acting mechanism of the leaf spring can be utilized to cause the lateral lids to pivot between two different positions to open and close the lateral openings depending on the direction in which the knob is moved.

The publication now under discussion merely says that, when and so long as the knob is in the opened position with the lateral lids opening the lateral openings, the interior of the shaving head can receive a brush inserted therein through either of these lateral openings for the removal of the hair clippings, but is silent as to the capability of the electric shaver being washed with water.

SUMMARY OF THE INVENTION

In any event, the present invention has been devised to substantially eliminate the disadvantages and inconveniences discussed as inherent in the prior art washable electric shavers and has for its essential object to provide an improved washable electric shaver which can be washed with water until it is substantially clean with no difficulty and with no possibility of water being substantially permitted to wet the body of the shaver.

Another important object of the present invention is to provide an improved electric shaver of the type referred to above having a specially designed configuration to improve the ease to hold the shaver with care having been taken in selecting the position of a lid opening knob in relation to a power switch.

A further object of this invention is to provide an improved electric shaver of the type referred to above, which can be manufactured with a minimum number of component parts and is easy to fabricate.

In order to accomplish these objects, according to a preferred embodiment of this invention, there is provided a washable electric shaver which comprises a generally elongated water-tight housing accommodating therein an electrically powered motor and providing a grip for holding by the hand of the user, and a shaving head mounted on one end of the water-tight housing or body. The shaving head comprises a generally T-shaped configuration of one-piece construction having a hollow stem having one end so sized as to permit the exterior surface thereof to be continuous with the exterior surface of the water-tight housing and the other end formed integrally with a transverse bench which extends laterally outwardly therefrom in opposite directions. The shaving head also comprises a generally semi-circular cross-sectioned cap removably mounted on the transverse bench and having a pair of opposite end openings adjacent the respective ends of the bench and also a rectangular opening, both defined therein. This cap when mounted on the transverse bench defines the interior of the shaving head with the rectangular opening confronting the transverse bench.

The shaving head further comprises a stationary shear plate of any known construction having a multiplicity of fine perforations defined therein and replaceably mounted on the cap to cover the rectangular opening in a manner so as to have a curvilinear surface for the contact with the skin during the shaving. An elongated movable shear element of any known construction having a plurality of juxtaposed blades cooperable with the stationary shear plate to cut the hairs is supported within the interior of the shaving head on an eccentric shaft coupled to a drive shaft of the motor such that, when and so long as the motor is electrically powered, the movable shear element can be linearly vibrated in a direction generally parallel to the longitudinal sense of the transverse bench and perpendicular to that of the shaver body.

The end openings in the cap, generally lined up with the movable shear element and communicating with the interior of the shaving head, are adapted to be selectively opened and closed by associated lids which are normally biased to close the corresponding end openings. These lids may be pivotally mounted on either the cap or the transverse bench, however in the illustrated embodiment they are mounted on the cap to enhance the ease to fabricate and also to minimize the number of projections which may be exposed to the outside when the cap is removed from the transverse bench. For moving the lids to open the end openings, the shaving head includes a manipulatable slide knob, movable between opened and closed positions in a direction generally perpendicular to the longitudinal sense of the transverse bench, and a motion transmitter for transmitting the movement of the slide knob to the lids. The motion transmitter may be a rigid member, having its intermediate portion coupled to the slide knob and the opposite ends thereof engageable with the respective lids.

The slide knob may have a detent mechanism for avoiding the possibility that the slide knob, once moved to the opened position, may be automatically returned to the closed position, upon the release of an external pushing force therefrom, under the influence of biasing forces acting on the lids to close the corresponding lids.

The washing of the shaving head to remove the hair clippings from the interior thereof is usually carried out while the lids are in position to open the end openings. At this time, the shaving head may be washed by either shaking the shaving head in a pool of water or allowing a flush of water to flow from one of the end openings to the other through the interior of the shaving head.

In accordance with another feature of this invention, the T-shaped configuration of the shaving head is so shaped as to have a constricted area generally at the junction between the stem and the transverse bench to facilitate the drainage of water drops which would otherwise flow towards the water-tight housing or grip, and also as to permit the shaving head to lean at a certain angle relative to the longitudinal sense of the grip in a manner with the longitudinal sense of the transverse bench lying in a plane at right angles to that of the grip to facilitate the ease to hold the shaver as a whole during the shaving operation.

BRIEF DESCRIPTION OF DRAWINGS

These and other objects and features of this invention will become apparent from the following detailed description taken in conjunction with a preferred embodiment thereof with reference to the accompanying drawings, in which.

Before the description of this invention proceeds, it is to be noted that like parts are designated by like reference numerals throughout the accompanying drawings.

DETAILED DESCRIPTION OF DRAWINGS

Figure 1:
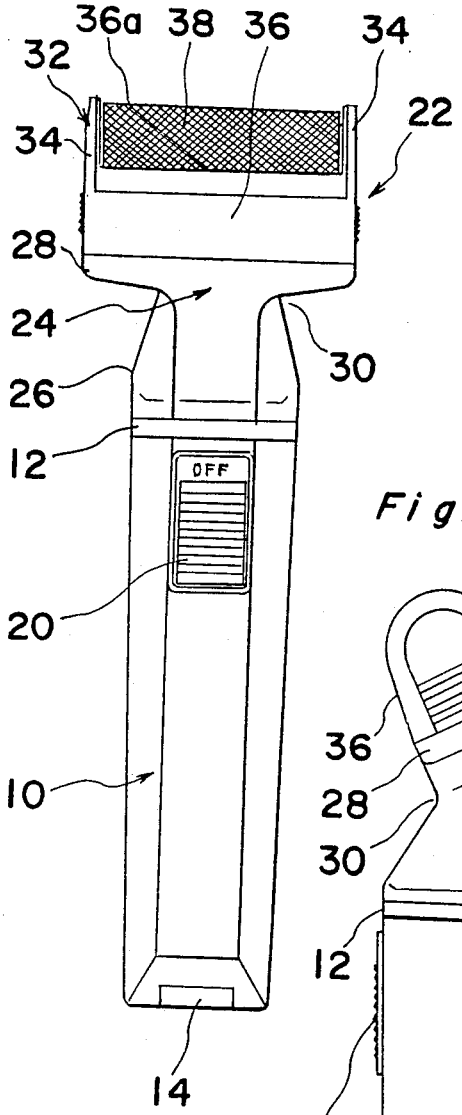
FIG. 1 is a front elevational view of a washable electric shaver according to this invention.
Figure 2:
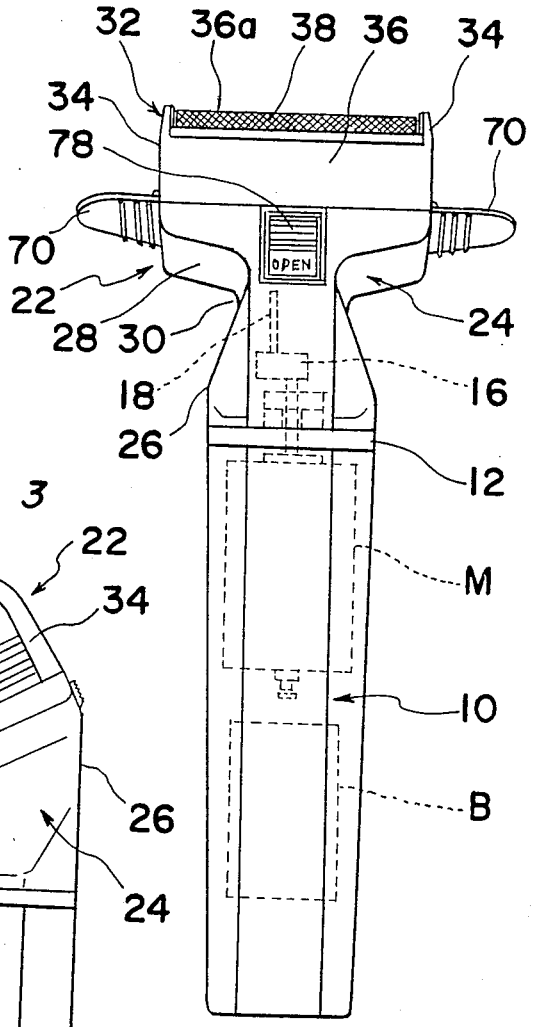
FIG. 2 is a rear elevational view of the shaver of FIG. 1, with its lids shown as opened.
Figure 3:
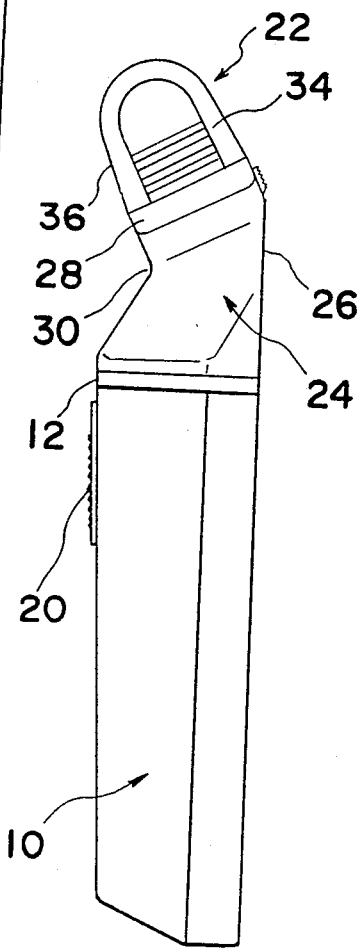
FIG. 3 is a side elevational view of the shaver of FIG. 1.

Referring first to FIGS. 1 to 3, a washable electric shaver according to this invention and shown therein is of a generally two-component structure comprising an elongated water-tight housing 10, which serves concurrently as a grip for holding by the hand of a user, and a shaving head 22. The housing 10 has one end closed by an end plate 12 in any suitable manner, but in any event in a water-tight fashion, and the other end closed by an end wall which may be either a separate member or an integral part of the housing 10. Preferably, the end wall at the other end of the housing 10 is formed with a recess 14 in which a pair of plug pins (not shown) for removable connection with an external electric power supply line (not shown) are exposed. As a matter of course, these plug pins are situated within the recess 14 and extend in a water-tight fashion through the end wall.

The housing 10 accommodates therein a micromotor M having its drive shaft rotatably extending through the end plate 12, in a water-tight fashion, the tip of which drive shaft has an eccentric flywheel 16 mounted thereon for rotation together therewith. The flywheel 16, capable of undergoing an eccentric rotation relative to the drive shaft of the motor M during the rotation of the latter, carries a drive pin 18 having one end rigidly secured thereto so as to extend in a direction opposite to and parallel to the drive shaft of the motor M, but in an axially offset relation to the drive shaft of the motor M.

The housing 10 has a slide 20 mounted exteriorly thereon for movement between on and off positions in a direction preferably parallel to the longitudinal sense thereof for controlling a power supply control switch (not shown) for initiating and interrupting the supply of an electric power to the motor M when the slide 20 is moved to the on position and the off position, respectively. The housing 10 may accommodate a battery source B therein, preferably a rechargeable battery, and an electric circuit associated with the electric component parts accommodated inside the housing 10.

Referring still to FIGS. 1 to 3, the shaving head 22 comprises a generally T-shaped body 24 constituted by a hollow stem 26 having one end mounted on the end plate 12 by means of either a screw mounting or a bayonet mounting so as to cover both the eccentric flywheel 16 and the drive pin 18, and a transverse bench 28 integral with the stem 26 and protruding laterally outwards from the other end of the stem 26 in a direction generally perpendicular to the longitudinal sense of the housing 10 as best seen from FIGS. 1 and 2. As best shown in FIG. 3, the stem 26, except for a rear portion thereof which is rearward to the slide 20, i.e., which is situated on one side of the shaver circumferentially opposite to the slide 20, is generally tapered inwardly, or is so shaped as to converge in a direction towards the transverse bench 28 so as to define a constricted area 30 generally at the junction between the stem 26 and the transverse bench 28. In addition, the transverse bench 28 integral with the stem 26, is so molded together with the stem 26 and so shaped as to tilt at a certain angle relative to a plane perpendicular to the longitudinal sense of the housing 10 or the shaver body in a direction substantially frontward towards the slide 20, as viewed in FIG. 3.

In other words, the head body 24 of one-piece construction including the stem 26 and the transverse bench 28 is molded to such a shape that the shaving head 22 is tilted forwards at a certain angle relative to the elongated housing 10 so that, during the shaving of the hairs, it can incidentally lean against the skin even when the housing 10 held in the hand of the user is generally positioned upright.

The shaving head 22 also comprises a cap 32 of a shape generally similar to the inverted shape of a figure "U" comprised of a pair of opposite end walls 34 of a generally inverted U-shape and a wall 36 of a generally inverted U-shape having its opposite U-shaped lateral edges continued to the U-shaped peripheral edge portions of the respective end walls 34. The end walls 34 have end openings **34*a* (FIGS. 4 and 5) defined therein, respectively, each being of a shape similar to the shape of any one of the end walls 34, and the wall 36 also has a shaving opening 36*a* defined therein at a location corresponding to the bottom of the shape of the figure "U" and extending between the end walls 34. A flexible stationary shear plate 38 having a multiplicity of fine perforations defined therein in a predetermined or desired pattern is replaceably mounted on the cap 32 in any known manner so as to cover the shaving opening 36*a*, the stationary shear plate 38 being so bent as to follow the contour of the U-shaped peripheral edge portions of the respective end walls 34**.

Hereinafter, an internal mechanism of the shaving head 22 will be described with particular reference to FIGS. 4 to 11. As can readily be understood from FIGS. 4 to 9, the transverse bench 28 is, when generally viewed from top, rectangular in shape, having a pair of opposite end walls **28*a*, a pair of opposite side walls 28*b* and a bottom wall 28*c*, the walls 28*a* and 28*b* being continued to and integral with the stem 26 through the bottom wall 28*c*, and the bottom wall 28*c* being discontinued by a bottom opening which is defined therein in communication with the hollow of the stem 26**.

Referring still to FIGS. 4 to 9, the transverse bench 28, essentially in the form of a receptacle, is closed by a rectangular cover plate 40 to form a generally flattened space therebetween. This cover plate 40 is secured by means of set screws 42 to a pair of spaced projections 44 integral with and protruding outwards from the bottom wall **28*c* in a direction away from the stem 26, and has a central aperture 40*a* defined therein, and also a pair of opposite hollow bearing projections 46 located adjacent the opposite ends thereof and protruding therefrom at right angles in a direction away from the stem 26. The bearing projections 46 carry detent pieces 48, respectively, which detent pieces 48 are collapsibly supported thereby, but are normally biased by associated springs 50 within the bearing projections 46 so as to project laterally outwardly therefrom in the opposite directions away from each other for engagement into corresponding detent recesses, defined in the interior surfaces of the respective end walls 34 of the cap 32 to hold the cap 32 in the form as mounted on the transverse bench 28. Thus, it will readily be seen that the cap 32 with the stationary shear plate 38 thereon can be removed from the transverse bench 28 merely by pulling it outwards in a direction generally perpendicular to the bench 28 thereby allowing the detent pieces 48 to be temporarily collapsed inwardly of the respective projections 46 against the springs 50 to let the end walls 34 pass over the detent pieces 48**.

Figure 4:
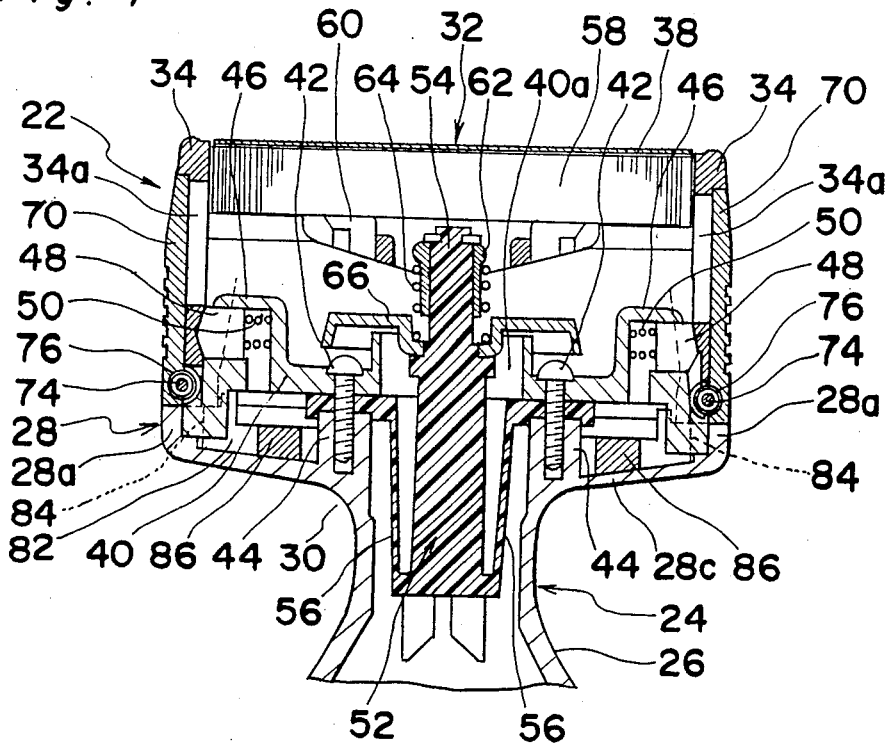
FIG. 4 is a sectional view, on an enlarged scale, of a shaving head of the shaver of FIG. 1, showing the lids closed.
Figure 5:
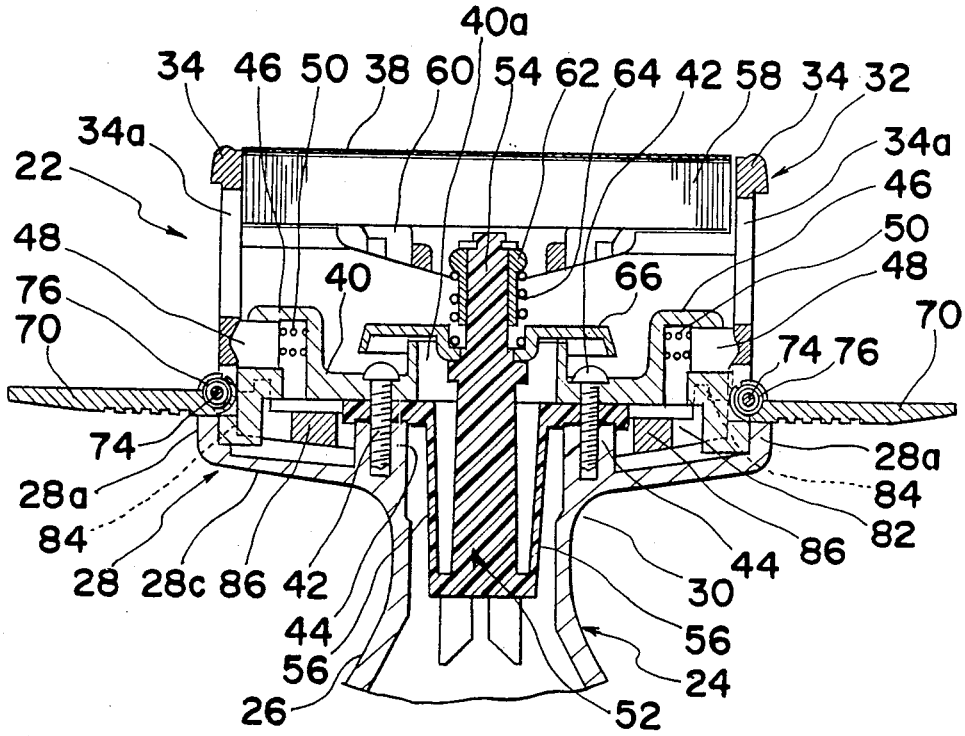
FIG. 5 is a view similar to FIG. 4, showing the lids opened.

Extending loosely through the central opening **40*a* in the cover plate 40 and also through the bottom opening in the bottom wall 28*c* of the transverse bench 28 is an oscillating carriage 52 operatively coupled to the drive pin 18 (FIG. 2) for the oscillatory motion in a direction generally perpendicular thereto and parallel to the longitudinal sense of the transverse bench 28. The oscillating carriage 52 includes a post 54 having one end situated within the hollow of the head body 24 and formed integrally with a pair of opposite flexible arms 56 which extend axially inwardly thereof towards the other end of the post 54 generally in parallel relation to each other, the free ends of the arms 56 being firmly clamped between the projections 44 and the cover plate 40 with the set screws 42 passing therethrough as best shown in FIGS. 4 and 5. With the oscillating carriage 52 so supported, the drive pin 18 (FIG. 3) projects axially inwards into the post 54 wherefore, during the eccentric rotation of the flywheel 16 as a result of the rotation of the motor M, the post 54 can be oscillated in a direction generally perpendicular thereto and parallel to the longitudinal sense of the transverse bench 28. The other end of the post 54, situated within the cap 32, has a generally elongated movable shear element 58 yieldingly mounted thereon through a holder 60 of any known construction in a known manner. More specifically, the holder 60 having the movable shear element 58 replaceably mounted thereon has a bushing 62 supported thereby for pivotal movement in a plane parallel to the lengthwise direction of the movable shear element 58 and is carried by the oscillating carriage 52 with the bushing 62 mounted axially non-movably on the other end of the post 54**.

The movable shear element 58, comprised of a plurality of closely juxtaposed blades as is well known to those skilled in the art, is normally biased so as to contact the stationary shear plate 38 by a compression spring 64 interposed between the bushing 62 and a closure plate 66. The closure plate 66 is mounted on the post 54 for oscillatory movement together therewith and is used to close the central opening 40*a* in the cover plate 40 to prevent the clippings of the hairs from falling into the hollow of the stem 26 therethrough and then through the bottom opening in the transverse bench 28.

In the construction so far described, it will readily be seen that, during the rotation of the motor, the movable shear element 58 can be oscillated relative to the stationary shear plate 38 in a direction transversely of the drive pin 18 then undergoing an eccentric motion together with the eccentric flywheel 16, cooperating with the stationary shear plate 38 to cut hairs which have projected throught the fine perforations in the stationary shear plate 38 for engagement by the movable shear element 58. In any event, the manner by which both the stationary and movable shear elements 38 and 58 are supported relative to each other may not be limited to those described and illustrated, but may be of any known construction.

In accordance with a feature of this invention, the shaving head 22 further comprises a pair of lateral lids, generally identified by 70, for selectively closing and opening the end openings 34*a* in the cap 32. So far illustrated the latteral lids 70 are pivotally carried by the cap in a manner which will now be described with particular reference to FIGS. 8 to 11. However, it is to be noted that, since the lateral lids 70 are supported by the respective end walls 34 of the cap 32 in the same manner, reference will be made to only one of the lateral lids 70 for the sake of brevity.

Figure 8:
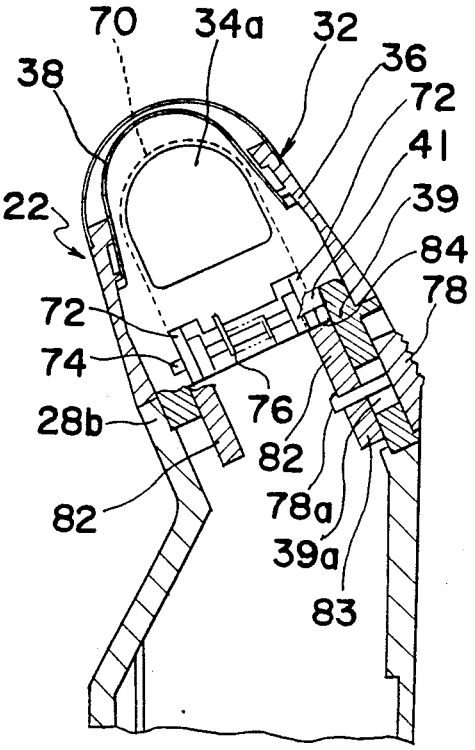
Figure 9:
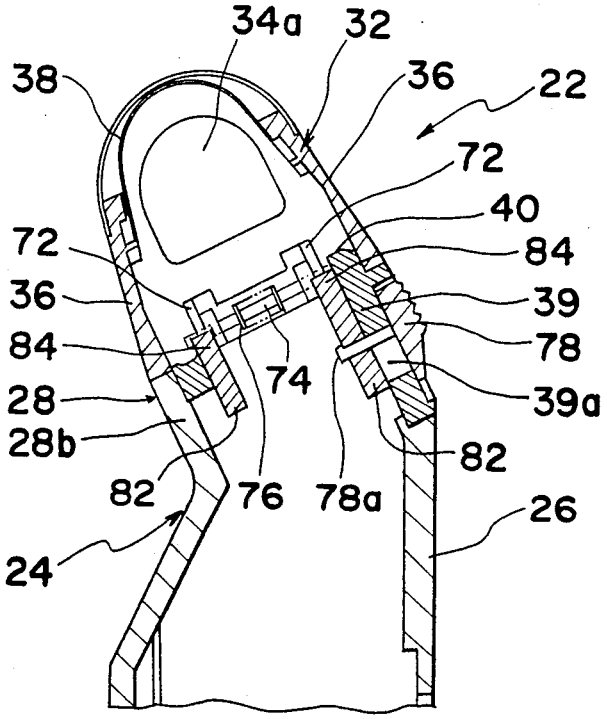
FIG. 9 is a view similar to FIG. 8, showing a slide knob moved to an opened position to open the lids.
Figure 10:
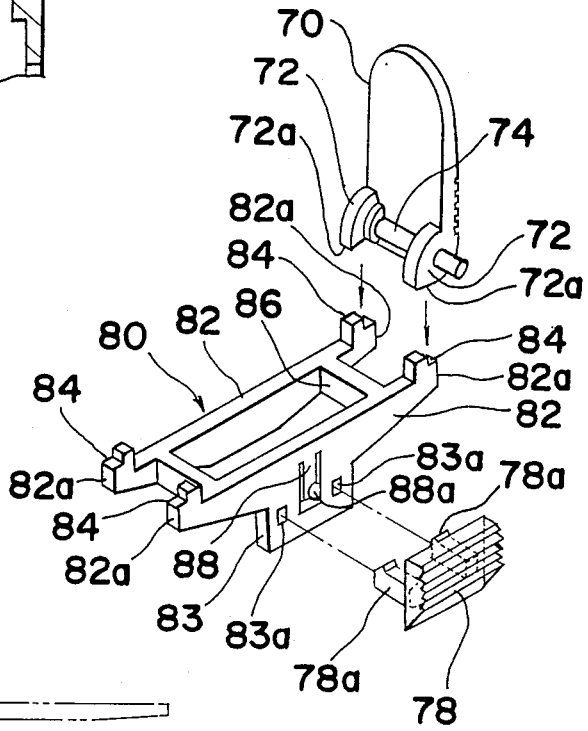
FIG. 10 is an exploded view of a mechanism for selectively opening and closing the lids, with only one of the lids being shown.
Figure 11:
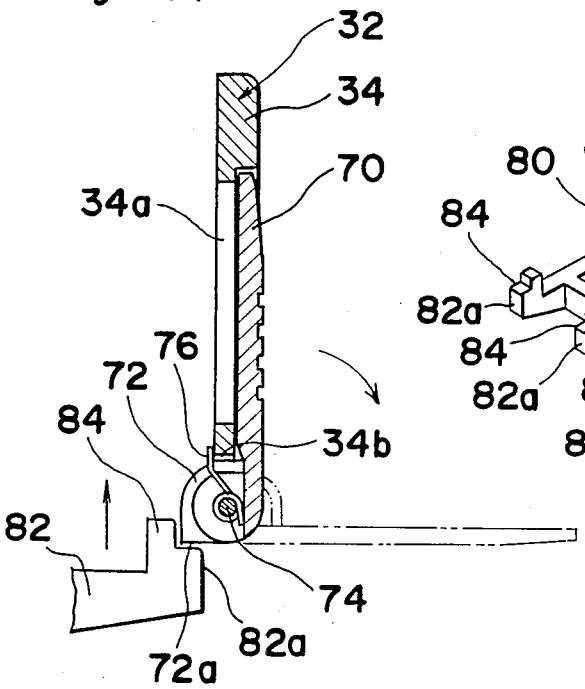
FIG. 11 is a sectional view, on a further enlarged scale, showing the manner in which the lids are selectively opened and closed.

Referring now to FIGS. 8 to 11, and as best shown in FIG. 10, the lateral lid 70 is generally similar in shape to the shape of the respective end wall 34 of the cap 32 where the associated end opening 34*a* is defined, but is of a size sufficient to completely cover the end opening 34*a*. This lateral lid 70 has one end generally rounded and the other end formed integrally with a pair of spaced bearing flanges 72 of a generally sector-shaped configuration protruding outwardly therefrom in a direction at right angle to the body of the lateral lid 70. The lateral lid 70 has a shaft 74 rotatably extending through the bearing flanges 72 with its opposite ends situated exteriorly thereof and secured to the associated end wall 34. The securement of the opposite ends of the shaft 74 to the associated end wall 34 may be carried out by pressure-fitting them into correspondingly spaced recesses (not shown) defined in one surface of the associated end wall 34 facing the interior of the cap 32, or in any suitable manner readily conceivable to those skilled in the art. It is to be noted that, with the lateral lid 70 so supported, the bearing flanges 72 project into the interior of the cap 32 through a cutout area defined at 34*b*, as shown in FIG. 11, in the associated end wall 34. The lateral lid 70 is normally held in position to close the end opening 34*a* in the associated end wall 34 by the action of a coil or torsion spring 76 having its opposite ends engaged respectively to the end wall 34 and the lateral lid 70, a substantially intermediate coiled portion thereof being loosely mounted on the shaft 74 at a location between the bearing flanges 72.

Figure 12:
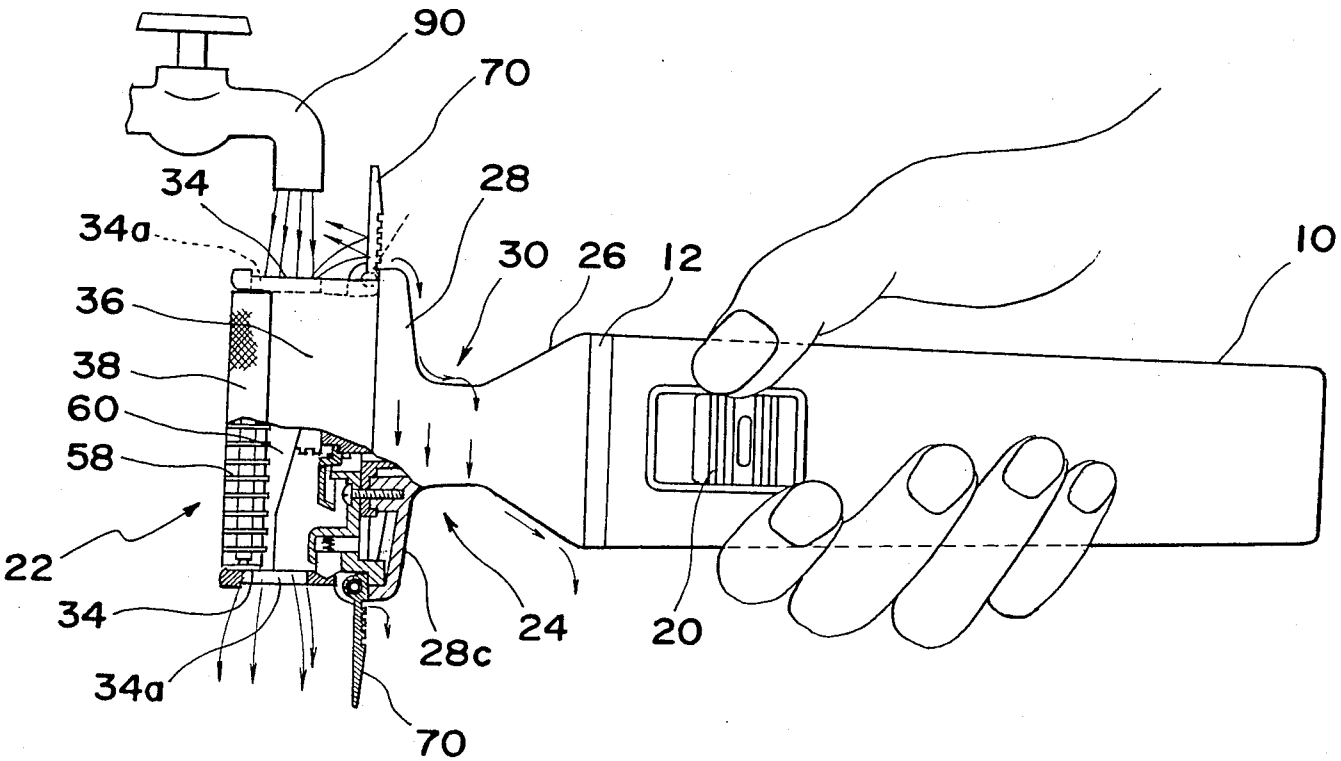
FIG. 12 is a front elevational view of the shaver, with a portion cut away, showing the shaver being washed with a flush of water coming from a water faucet.

While each of the lateral lids 70 is constructed and supported in the manner as hereinbefore described, it is to be noted that, when these lateral lids 70 are pivoted against the respective coil springs 76 to open the associated end openings 34*a* as shown in FIGS. 2, 5 and 9, they spread in the opposite directions with respect to each other in a plane generally perpendicular to the plane of each of the end openings 34*a* and also generally parallel to the transverse bench 28 as best shown in FIGS. 5 and 12. For selectively opening and closing the lateral lids 70 simultaneously, a switching mechanism is utilized, which comprises a manipulatable slide knob 78 and a motion transmitter 80.

Figure 6:
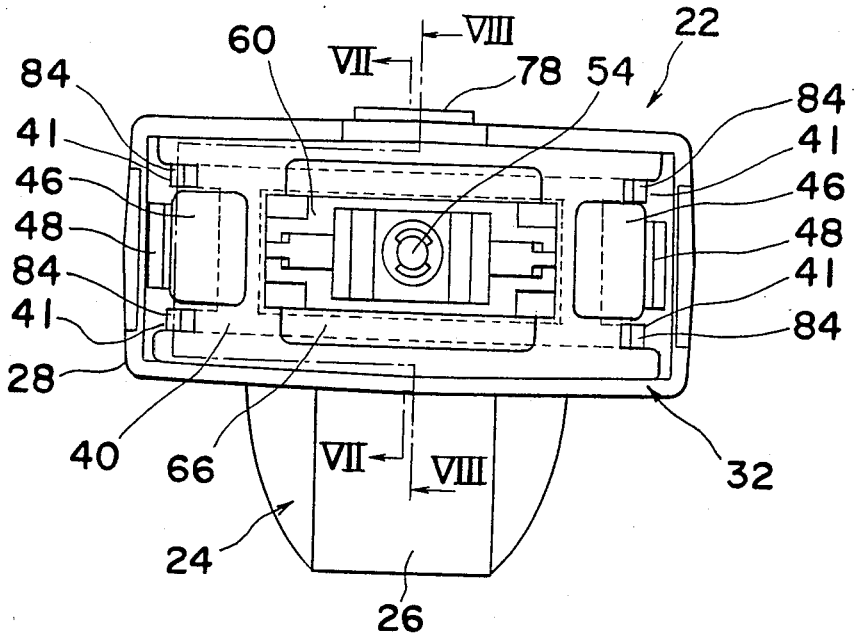
FIG. 6 is a top plan view, on an enlarged scale, of the shaver with a movable shear element removed to show the interior of the shaving head.

The motion transmitter 80 so far shown is of one-piece construction including a pair of elongated beams 82 connected together by a pair of spaced bridges 86, one of the elongated beams 82 having its substantially intermediate portion which is integrally formed with a connecting flange 83 for connection with the slide knob 78 in a manner described later. As best shown in FIG. 10, each of the beams 82 has a pair of engagement projections, generally identified by 84, which projections 84 are integrally formed therewith and protrude therefrom in a direction at right angles to the respective beam 82. This motion transmitter 80 is accommodated within the generally flattened space between the transverse bench 28 and the cover plate 40 for movement in a direction towards and away from the cover plate 40 as best shown in FIGS. 4 and 5. It is to be noted that, with the motion transmitter 80 so accommodated movably, the projections 84 on the beams 82 are aligned with corresponding openings 41 defined in the cover plate 40 at its four corners as shown in FIG. 6, confronting through such openings 41 with respective flat edges 72*a* of the bearing flanges 72 of the lateral lids 70 in a manner substantially as shown in FIG. 11. Thus, it will readily be seen that, as the motion transmitter 80 within the above described flattened space between the transverse bench 28 and the cover plate 40 is moved close towards the cover plate in a manner as will subsequently be described, the engagement projections 84 contact and push the flat edges 72*a* of the bearing flanges 72 fast with the lateral lids 70, thereby causing the lateral lids 70 to pivot against the associated coil springs 76 to open the end openings 34*a* in the end walls 34 of the cap 32. It will also readily be seen that, when the lateral lids 70 are so opened, the flat edges 72*a* of the bearing flanges 72 fast with the lateral lids 70 are held in contact with the end faces of the associated beams 82, respectively, and therefore, the lateral lids 70 can be kept in position to open the end openings 34*a* so long as the motion transmitter 80 is held in a position close to the cover plate 40 as shown in FIGS. 5 and 9.

Figure 7:
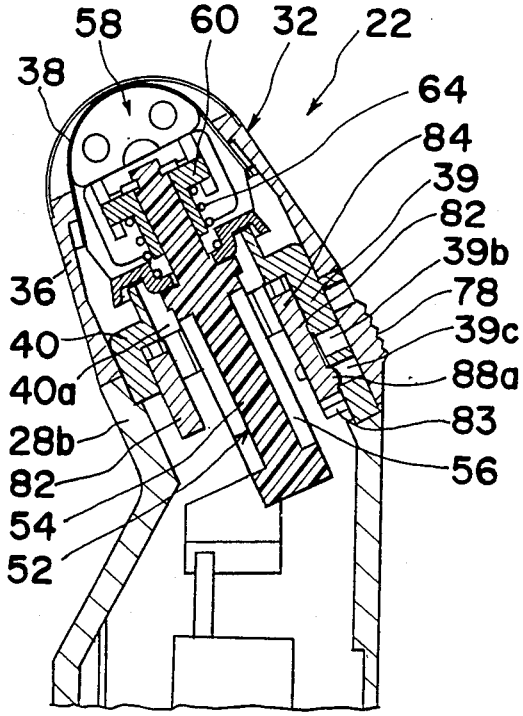
FIGS. 7 and 8 are cross-sectional views of the shaving head taken along the lines VII—VII and VIII—VIII in FIG. 6.

Referring to FIGS. 7 to 9, the cover plate 40 has one side edge formed integrally with a depending plate 39 positioned in overlapping relation to the connecting flange 83 integral with the beam 82 and received in a recess (not shown) defined in one of the side walls 28*b* of the transverse bench 28 which is located on one side of the housing 10 opposite to the switch slide 20 and adjacent the junction between the transverse bench 28 and the stem 26 as shown in FIG. 3. The depending plate 39 has a pair of slots 39*a* defined therein for the passage of connecting arms 78*a* of the manipulatable slide knob 78 therethrough for connection with the connecting flange 83 in a manner as will be described later, each of said slots extending in a direction perpendicular to the transverse bench and being so sized as to permit the slide knob 78 to be moved between opened and closed positions. The depending plate 39 also has a pair of spaced detent holes 39*b* and 39*c* (FIG. 7) defined therein at a location intermediately between the slots 39*a*, which detent holes 39*b* and 39*c* correspond to the opened and closed positions, respectively, of the slide knob 78.

For cooperating with the detent holes 39*b* and 39*c* in the depending plate 39 integral with the cover plate 40, the connecting flange 83 integral with the beam 82 of the motion transmitter 80 is formed with a generally U-shaped cutout so as to leave a resilient tongue 88 which has a rounded detent projection 88*a* integrally formed therewith, or otherwise rigidly mounted thereon, for the selective engagement into the detent holes 39*b* and 39*c* one at a time.

The slide knob 78 having the arms 78*a* integrally formed therewith is rigidly connected to the connecting flange 83 with the arms 78*a* loosely extending through the spaced slots 39*a* in the depending plate 39 integral with the cover plate 40 such that the motion transmitter 80 can be moved together with the slide knob 78. Although the connection of the arms 78*a* to the connecting flange 83 may be accomplished in any suitable manner, for example, by the use of a bonding agent or a pressure-fitting technique, an anchoring method is employed in the preferred embodiment. For this purpose, while the free ends of the respective arms 78*a* are so shaped as to represent an anchor, the connecting flange 83 is formed with a pair of anchoring holes 83*a* spaced from each other a distance slightly greater or smaller than the span between the arms 78*a* so that the arms 78*a* can be connected to the connecting flange 83 by inserting the arms 78*a* into the associated anchoring holes 83*a* while the arms 78*a* are allowed to outwardly or inwardly deform against their own resiliency, as the anchor-shaped free ends of said arms 78*a* pass therethrough, and then to let them resume the original positions.

From the foregoing description, it has now become clear that, when the slide knob 78 in the closed position as shown in FIG. 8 is moved towards the opened position by the application of an external pushing force thereto, the motion transmitter 80 is generally upwardly shifted, as viewed in FIGS. 7 to 9 with the engagement projections 84 consequently brought into engagement with the flat edges 72*a* of the bearing flanges 72 of the lateral lids 70, the lateral lids 70 being completely opened as shown in FIG. 5 when the slide knob 78 is subsequently clicked into the opened position as shown in FIGS. 2 and 9. At this time, the detent projection 88*a* (FIGS. 7 and 10) is engaged in the detent hole 39*b* to substantially lock the slide knob 78 in the opened position even though the composite force of the coil springs 76 tending to close the lateral lids 70 may be transmitted to the slide knob 78 through the motion transmitter 80.

However, the application of an external pulling force to the slide knob 78 to move the latter from the opened position towards the closed position results in the pivotal movement of the lateral lids 70 by the action of the coil springs 76 to close the respective end openings 34*a*. It is to be noted that at this time, i.e., as the slide knob 78 is moved towards the closed position, the detent projection 88*a* that has been engaged in the detent hole 39*b* is passed onto the detent hole 39*c* allowing the tongue 88 to flex against its own resiliency.

The washable electric shaver constructed and operable in the manner described hereinbefore can be washed in the following manner after or during the course of the shaving operation.

Referring to FIG. 12, after the shaving has been done, or in the course of the shaving operation, and when the shaving head 22 is desired to be washed, the user should move the slide knob 78 from the closed position to the opened position to open the lateral lids 70. Then, the shaver should be held in position with either one of the end openings 34*a* aligned with a flush of water flowing from a city water supply faucet 90, allowing the water to flow from one end opening 34*a* to the other through the interior of the shaving head 22 as shown. At this time, the lateral lids 70 in their opened positions concurrently serve as baffles for substantially preventing, or minimizing, the water from splashing rearwardly onto the housing or grip 10. However, should it happen that the water used to wash the shaving head 22 splashes or overflows so much as to flow towards the housing or grip 10, the splashing or overflowing water can advantageously be drained, in a manner as shown by the arrow-headed lines in FIG. 12, because of the presence of the constricted area 30 (FIGS. 1 to 3) defined exteriorly between the stem 26 and the transverse bench 28. Accordingly, the splashing or overflowing water will not substantially reach the housing or grip 10 and, therefore, the housing or grip 10 can advantageously firmly held by the hand of the user with no substantial possibility of the occurrence of slip between the hand and the exterior surface of the housing or grip 10. In addition, the hair clippings washed out from the shaving head 22 will not adhere to the housing or grip 10 because the water that has flown through the interior of the shaving head carrying the hair clippings does not flow upwards, as viewed in FIG. 12, along the transverse bench.

Moreover, since the slide knob 78 is arranged at a location circumferentially opposite to the switch slide 20 with respect to the body or housing of the shaver and is arranged adjacent the junction between the stem 26 and the transverse bench 28 where the transverse bench 28 tilts relative to the stem 28, there is no possibility of the slide knob 78 being erroneously moved during the shaving.

Although this invention has fully been described in connection with the preferred embodiment thereof with reference to the accompanying drawing, it is to be noted that various changes and modifications are apparent to those skilled in the art from the reading of the disclosure set forth above. By way of example, it is possible to employ a single engagement projection on the motion transmitter for each of the lateral lids. In addition, the shape and constuction of the motion transmitter may not be limited to those described and shown, but may be in the form of an elongated plate or strip having its opposite ends formed with the engagement projections.

Such changes and modifications are, unless they depart from the scope of this invention as defined by the appended claims, to be understood as included therein accordingly.

What is claimed is:

1. A washable electric shaver comprising, in combination:

a generally elongated water-tight housing serving concurrently as a grip;

a drive unit housed within said housing;

an operating element mounted on said housing for controlling a power supply control switch for interrupting and initiating supply of electric power to said drive unit;

a generally T-shaped shaving head including a hollow stem mounted at one end on said housing so as to render said shaver as a whole to represent a generally T-shaped configuration integral with a transverse bench portion a cap mounted removably on said portion, said cap having a pair of spaced end openings defined therein and located substantially on respective sides of said housing, a stationary shear plate replaceably carried by said cap, a generally elongated shear element for movement in engagement with said stationary shear plate to cut hairs to be shaved, and means for supporting said movable shear element within said stem portion and for transmitting a drive from said drive unit thereto, said end openings being aligned with each other and positioned adjacent opposite ends of said movable shear element;

a pair of pivotally supported lateral lids provided on said cap for selectively opening and closing said respective end openings;

means for biasing said lateral lids to open and close said associated end openings;

a slide element supported on said stem portion movable between open and closed positions, said slide element when moved from said close position to said open position bringing said lateral lids in position to open said end openings;

means for transmitting the movement of said slide element to said lateral lids; and an eccentric drive pin coupled with said drive unit for driving connection with said means for supporting said movable shear element and said transmitting means when said shaving head is mounted on said one end of said housing, said slide element being positioned on said shaver head circumferentially opposite to said operating element on said housing.

2. The shaver of claim 1, wherein said transverse bench is tilted forward and upwards relative to said stem such as to position said shaving head so as to confront a face of the user when the housing held by a hand of the user is generally positioned vertically, and wherein said slide element is provided on said T-shaped shaving head at a location adjacent a junction between said stem and said transverse bench portion facing in a direction generally opposite to the direction in which said bench is tilted.

3. The shaver of claim 2, wherein said T-shaped shaving head has a constricted area defined at said junction between said stem and said transverse bench.

4. The shaver of claim 1, wherein said lateral lids are pivotally supported on said transverse bench, and wherein said lateral lids when held in an open position lie in a plane parallel to said movable shear element and extend outwards therefrom in opposite directions with respect to each other perpendicular to each of said respective end openings.

* * * * *